US008602270B2

(12) United States Patent
Takanohashi

(10) Patent No.: US 8,602,270 B2
(45) Date of Patent: Dec. 10, 2013

(54) CONNECTOR FOR A FLUID TANK

(75) Inventor: Toshiyuki Takanohashi, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 839 days.

(21) Appl. No.: 12/356,216

(22) Filed: Jan. 20, 2009

(65) Prior Publication Data

US 2009/0184119 A1 Jul. 23, 2009

(30) Foreign Application Priority Data

Jan. 21, 2008 (JP) ..... 2008-010934

(51) Int. Cl.
*B65D 83/00* (2006.01)

(52) U.S. Cl.
USPC ..... 222/400.7; 222/386.5; 137/212

(58) Field of Classification Search
USPC ..... 222/386.5, 389, 399, 400.5, 400.7, 386; 137/212
See application file for complete search history.

(56) References Cited

U.S. PATENT DOCUMENTS

| | | | | | |
|---|---|---|---|---|---|
| 3,065,885 | A | * | 11/1962 | Chatten | 222/400.7 |
| 3,591,058 | A | * | 7/1971 | Johnston | 222/400.7 |
| RE27,626 | E | * | 4/1973 | Johnston | 222/400.7 |
| 4,736,926 | A | * | 4/1988 | Fallon et al. | 251/149.9 |
| 5,108,015 | A | * | 4/1992 | Rauworth et al. | 222/400.7 |
| 5,875,921 | A | * | 3/1999 | Osgar et al. | 222/1 |
| 5,957,328 | A | * | 9/1999 | Osgar | 222/1 |
| 5,971,019 | A | * | 10/1999 | Imai | 137/614.04 |
| 6,109,485 | A | * | 8/2000 | Amidzich | 222/400.7 |
| 6,237,809 | B1 | * | 5/2001 | Kawai et al. | 222/95 |
| 6,286,730 | B1 | * | 9/2001 | Amidzich | 222/400.7 |
| 6,302,148 | B1 | * | 10/2001 | Imai | 137/614.04 |
| 6,505,863 | B2 | * | 1/2003 | Imai | 285/316 |
| 8,052,014 | B2 | * | 11/2011 | Hasegawa et al. | 222/400.7 |

FOREIGN PATENT DOCUMENTS

| | | | |
|---|---|---|---|
| JP | 2002-059993 | | 2/2002 |
| JP | 2007-204102 | A | 8/2007 |
| TW | 506941 | B | 10/2002 |
| TW | 528725 | B | 4/2003 |
| WO | WO 2006/070638 | A1 | 7/2006 |

* cited by examiner

*Primary Examiner* — Frederick C Nicolas
(74) *Attorney, Agent, or Firm* — Alston & Bird LLP

(57) ABSTRACT

A fluid tank connector enables reliable separation of a plug and a socket by opposing the coupling force of a fluid sealing portion. The fluid tank connector is provided with a plug that is fit with play in the inner periphery of a fluid port of the fluid tank that stores a fluid, and a socket that is detachably connectable to the plug. The socket includes a sleeve that connects and disconnects the socket and the plug by being threadable on an external thread that is formed on the outer periphery of the fluid port. A pressing device is provided in the socket, and the pressing device applies a pressing force that separates the plug from the socket by opposing the coupling force of an O-ring that seals the fluid path between the plug and the socket.

2 Claims, 6 Drawing Sheets

CONNECTOR FOR A FLUID TANK

CROSS REFERENCE TO RELATED APPLICATIONS

This application claims priority to Japanese Patent Application No. 2008-010934 filed on Jan. 21, 2008, the contents of which are incorporated herein by reference.

FIELD OF THE INVENTION

The present invention relates to a fluid tank connector for delivering a fluid that is inside a fluid tank to the outside thereof.

BACKGROUND OF THE INVENTION

Generally, fluids such as high-purity chemical products for semiconductors or general-use chemical products are filled into fluid tanks such as polyethylene tanks at a production facility, and they are shipped after a lid has been attached to a fluid port for filling and discharging that is formed in this fluid tank. As a method for removing the fluid that has been stored in such a fluid tank, a siphon hose method is known in which a gas such as air is introduced into the container, and the fluid is fed to the outside of the container due to the gas pressure that is produced thereby.

In this method, after removing the lid that was attached to the fluid port of the fluid tank, a plug is installed in the fluid port, and then a socket is connected in the plug. The plug is provided with a siphon hose, which forms a fluid path, and a gas supply duct. The socket is provided with a tube for removing fluid to the outside of the fluid tank and a tube for introducing gas. The socket enables the respective communication between its tube for removing fluid and the tube for introducing gas with the siphon hose and the gas supply duct of the plug. By connecting the socket into the plug, a fluid path for removing fluid and a gas path for introducing gas are formed. Such a fluid tank connector is disclosed, for example, in Japanese Unexamined Patent Application, First Publication No. 2002-59993.

However, the above patent document discloses a plug that is fastened by being threaded onto an internal thread that has been formed on the inner periphery of the fluid port of the fluid tank. Therefore, the plug cannot be used in a container in which an external thread has been formed on the fluid port, that is, a container in which the thread for the installation of a cap that closes the fluid port is an external thread.

Thus, in order to connect the plug and the socket to a fluid tank in which the fluid port has an external thread, a construction can be considered in which the plug is disposed at the inner periphery of the fluid port, and a sleeve that is provided on the socket is then threaded onto the external thread of the fluid port. In this case, an attachment method can be considered in which a plug that is provided with a catch is pressed into the fluid port under the assumption that the plug will not be removed therefrom. However, under these circumstances, such a method cannot meet the needs of a user who, for various reasons, wishes to remove the plug. In contrast, a construction can be considered in which the plug is fit into the inner periphery of the fluid port with some play so that the plug can be removed therefrom. However, in this construction, the coupling force (frictional force) of a fluid sealing portion (for example, an O-ring), which is provided between the plug and the socket when the fluid path is formed, is strong, and there is a concern that the plug may be pulled out from the fluid port along with the socket.

BRIEF SUMMARY OF THE INVENTION

In consideration of the circumstances described above, one object of the present invention to provide a fluid tank connector that enables the reliable execution of the separation of the plug and the socket by opposing the coupling force of the fluid sealing portion.

In order to attain the object described above, the present invention provides the following solutions.

The fluid tank connector according to one mode of the present invention is provided with a plug and a socket. The plug is disposed at the inner periphery of a fluid port of a fluid tank that stores a fluid and the socket can detachably connect to the plug. The socket includes a sleeve that detachably connects to the plug due to being threadable on a thread groove that is formed in the outer periphery of the fluid port. In a fluid delivery state in which the plug and the socket have been connected, a fluid path that delivers fluid from the fluid tank and a gas path that supplies gas into the fluid tank are formed. A characterizing feature of the fluid tank connector is that pressing means are provided that apply a pressing force that separates the socket and the plug by opposing the coupling force of a fluid sealing portion that seals the fluid path between the plug and the socket.

In the case in which the coupling force (frictional force) of the fluid sealing portion that is provided between the plug and the socket is strong, when the socket is to be separated from the plug, there is a concern that the connection between the plug and the socket will not be released and that the socket and the plug will both be removed from the fluid port of the fluid tank. In response to this, in this mode, because a pressing means is provided that separates the plug by opposing (overcoming) the coupling force of the fluid sealing portion, when the socket is removed from the plug, the socket can be reliably separated from the plug while the plug continues to remain connected to the fluid tank side.

Moreover, preferably, the pressing means are provided in the socket. It is thereby possible to simplify the structure of the plug.

Furthermore, in the fluid tank connector of the above mode, the plug may be fit with play in the fluid port.

There are cases in which, for various reasons, a user may wish to remove a plug from the fluid port of the fluid tank. In these cases, preferably, the plug is fit with play into the fluid port. Even when the plug is fit with play into the fluid port in this manner, it is possible to reliably separate the plug from the socket by using the pressing means, and thus, it is possible to avoid removing the plug from the fluid tank connected to the socket.

Furthermore, in the fluid tank connector in the mode described above, a gas sealing portion that seals the fluid path may be provided between the plug and the socket, and this gas sealing portion may be provided with a replaceable sealing member that is provided on the socket side.

The replaceable sealing member is provided on the socket side as a gas sealing portion. By replacing the sealing member, it is possible to maintain the gas sealing portion over a long period of time. In particular, because it is often the case that the socket is connected and attached to a facility side that supplies a fluid and frequent replacement cannot be carried out, it is possible to improve the serviceability by providing a replaceable sealing member in advance at the socket side.

Note that instead of the above mode, a convex portion (edge) may be formed on the socket side, and sealing may be carried out by pressing this convex portion against the plug side.

According to the present invention, because pressing means are provided that separate the plug by opposing (overcoming) the coupling force of the fluid sealing portion, when the socket is removed from the plug, it is possible to reliably separate the socket from the plug while the plug continues to remain disposed on the fluid tank side.

DETAILED DESCRIPTION OF THE INVENTION

An embodiment of the fluid tank connector according to the present invention will be explained with reference to the drawings.

Figure 1:
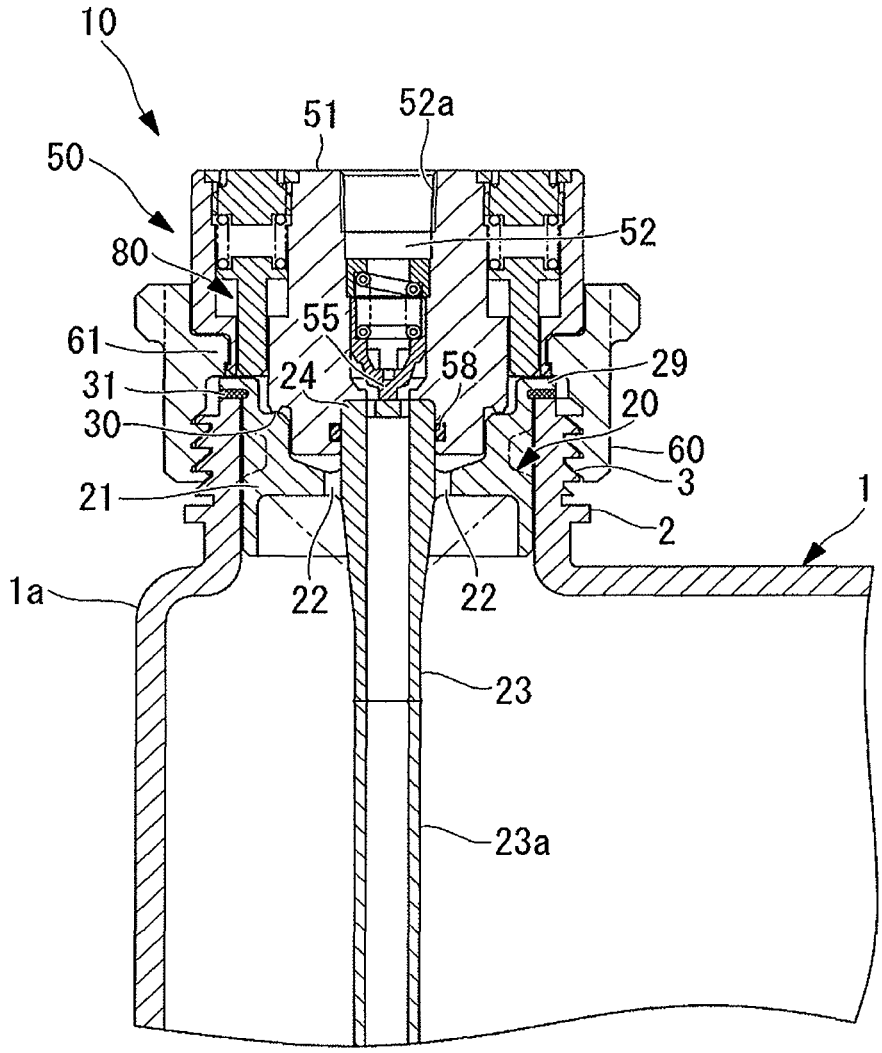
FIG. 1 is a cross-sectional view that shows the area around the fluid port of the fluid tank that is provided with the fluid tank connector according to an embodiment of the present invention.

FIG. 1 shows a fluid tank connector 10 that is installed in a fluid port 2 of a fluid tank 1. The fluid tank connector 10 is provided with a plug 20 that is accommodated inside the fluid port 2 and a socket 50 that is detachably connectable to the plug 20. The fluid tank connector 10 uses a siphon hose method, in which, in order to remove the fluid that is stored inside the fluid tank 1, a gas, such as air, is introduced to the inside of the fluid tank 1 and the fluid is fed to the outside of the fluid tank 1 due to the gas pressure that is produced thereby.

The fluid tank 1 that has been filled with a chemical fluid (fluid), such as a high-purity chemical product for semiconductors, is a molded product made, for example, of a chemical-resistant resin. The fluid port 2, which is provided at the top of the fluid tank 1, is an open portion that is used when a fluid such as a chemical product and the like is filled into the inside of the fluid tank 1 or when a chemical product inside of the fluid tank 1 is removed.

The fluid port 2 is a nozzle having a shape of a cylinder that opens at the upper end thereof and projects upward from the body 1*a* of the fluid tank 1, and although not shown, the open portion of the fluid tank 1 can be sealed by attaching a cap. The cap in this case is of a type in which an internal thread is formed on the inner peripheral surface thereof, and the cap is installed by being threaded onto the external thread 3 that is formed on the outer peripheral surface of the fluid port 2.

The plug 20 is a molded part made of resin and the like. It is inserted from above into the opening of the fluid port 2 and installed so as to be fitted with play. Specifically, the bottom end portion of the plug 20 has a tubular shape that provides neither a catch that engages the inner periphery of the fluid port 2 nor a thread that is threaded.

The plug 20 is provided with gas supply ducts 22 and a siphon hose 23, which are formed in the substantially tube shaped plug body 21.

The gas supply ducts 22 are ducts for supplying a gas that is introduced from the outside into the inside of the fluid tank 1. These gas supply ducts 22 are holes that pass through the plug body 21 in an axial direction, and they are provided in plurality so as to surround the siphon hose 23 that is disposed at the axial center of the plug body 21.

The siphon hose 23 is a path through which the fluid inside the fluid tank 1 is removed due to being pushed out by the pressure of the gas, and extends from the plug body 21 to the proximity of the bottom surface of the fluid tank 1. The necessary length of the illustrated siphon hose 23 is ensured by coupling an extension tube 23*a* to a portion that is integrally formed with the plug body 21. Note that in the following explanation, except where necessary, the entire tube, including the extension tube 23*a*, is referred to as the siphon hose 23.

In addition, at the upper end inlet portion of the siphon hose 23, a valve actuating portion 25 (refer to FIG. 5) is provided that pushes up and opens a fluid outflow valve 55 that is provided in the socket 50. The upper end inlet portion is only partially closed off by this valve actuating portion 25 (in particular, the axially central portion) because penetrating portions 25*a* (refer to FIG. 5), which serve as fluid paths for the siphon hose 23, are provided. The lower end portion of the valve 55 abuts and can thereby be pressed upward by the valve actuating portion 25. Note that, depending on the type of the socket 50 that is used in combination with the plug 20, there are cases in which this valve actuating portion 25 is unnecessary.

In addition, the plug 20 described above is provided with a flange portion 29 that is formed so as to face outward from the upper end portion of the plug body 21 and that is seated on the upper end surface of the fluid port 2. In addition, on the lower surface of the flange portion 29, where the flange portion 29 is in close contact with the upper surface of the fluid port 2, packing 31 is provided over the entire periphery thereof. This packing 31 functions as a sealing portion that prevents the discharge of gas between the fluid tank 1 and the plug 20 during the removal of fluid. In addition, during the transport of the fluid tank 1 or in the event that the fluid tank 1 is overturned, this packing 31 also functions as a seal that prevents the discharge of gas and fluid between the fluid tank 1 and the plug 20.

Furthermore, preferably, a ring-shaped convex portion (not illustrated) is also formed on the upper surface of the flange portion 29 described above so as to extend over the entire periphery thereof. When a cap is attached after the plug 20 has been press fit, this convex portion functions as a sealing portion that prevents the discharge of fluid caused by the fluid passing through the gas supply duct 22 due to the agitation of the fluid surface and the like during the transport of the fluid tank 1, or in the event that fluid tank 1 is overturned.

In the fluid tank connector 10 having the structure described above, as shown in FIG. 1, the socket 50 is coupled with the plug 20 when the fluid inside the fluid tank 1 is removed.

The socket 50 is provided with a socket body 51 and a sleeve 60 that fastens this socket body 51 to the fluid tank 1 so as to be inserted at a predetermined position in the plug 20. The socket body 51 is provided with a fluid removal path 52 and a gas path 53 (refer to FIG. 2) in a substantially columnar member. Note that the gas path 53 is not shown in the longitudinal cross-sectional view in FIG. 1 and the like.

The sleeve 60 can rotate with respect to the outer peripheral portion of the socket body 51. In addition, a concavoconvex engaging portion 61 that limits the movement of the socket body 51 in an axial direction is provided on the sleeve 60, and an internal thread 62 (refer to FIG. 5) is formed on the lower end portion side of the inner peripheral surface of the sleeve 60, and this internal thread 62 is threaded onto the external thread 3 of the fluid port 2. Specifically, when attaching the socket 50, after the socket body 51 is inserted into the plug 20 at a predetermined position, when the sleeve 60 is rotated to thread and fasten the internal thread 62 on the external thread 3, the socket body 51 is pulled down by the engaging portion 61 and is fastened so as to be in close contact with the plug 20. Thereby, the plug 20, which is fit with play into the fluid port 2, is fastened together with the socket 50. Specifically, the flange portion 29 of the plug 20 is interposed between the upper end surface of the fluid port 2 and the sleeve 60, and the plug 20 is thereby anchored to the fluid port 2.

The fluid removal path 52 is an axial through-hole that is formed at an axial center position in the socket body 51, and a connecting opening 52*a* for an external duct, through which fluid is discharged, is provided at the upper end portion thereof. When coupled with the plug 20, this fluid discharge path 52 forms an integrated fluid path by communicating with the siphon hose 23 that is inserted into the fluid tank 1. Note that an internal thread is formed on the illustrated connecting opening 52*a*. This internal thread threads and thereby couples with a plug (not illustrated) that is installed on one end of an external duct for fluid discharge.

The gas path 53 is a through-hole that is formed substantially parallel to the fluid removal path 52 described above. One end of the gas path 53 is connected to a gas supply source and the other end thereof communicates with the gas supply ducts 22 of the plug 20. An integrated gas path is formed by the gas path 53 and the gas supply ducts 22. A connecting opening 53*a* (refer to FIG. 2) for an external duct for a gas supply is provided on the upper end portion of the gas path 53, which is connected to a gas supply source. Note that an internal thread is formed on the illustrated connecting opening 53*a*. This internal thread threads onto and thereby couples with a plug (not illustrated)) that has been installed on one end of the external duct for gas supply.

Figure 3:
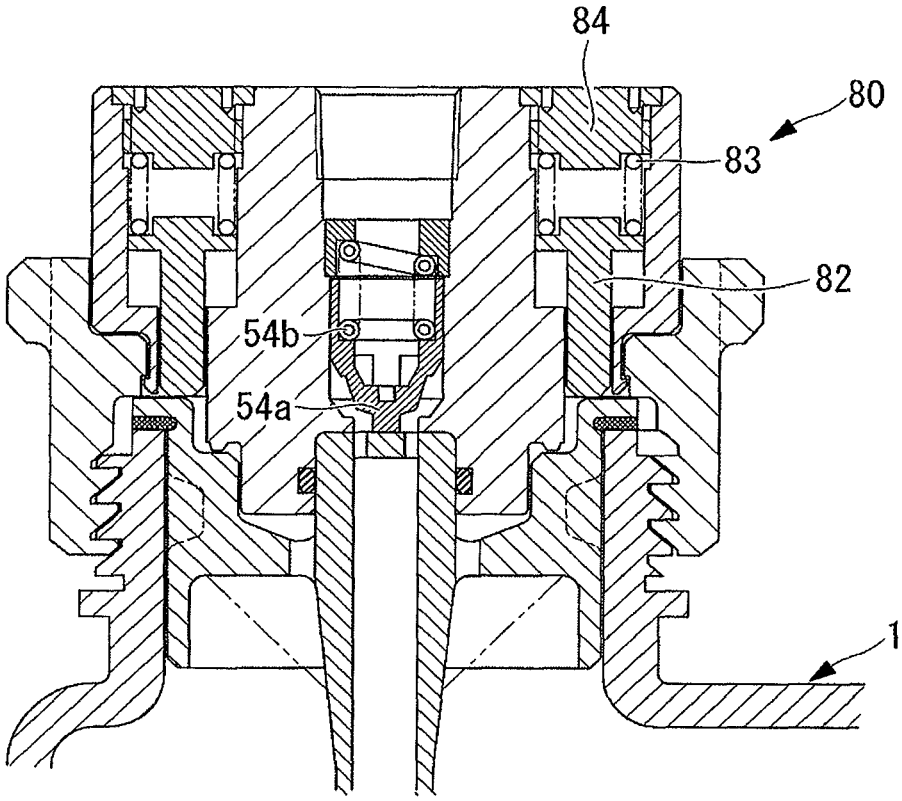
FIG. 3 is an enlarged cross-sectional view of the fluid tank connector in FIG. 1.
Figure 5:
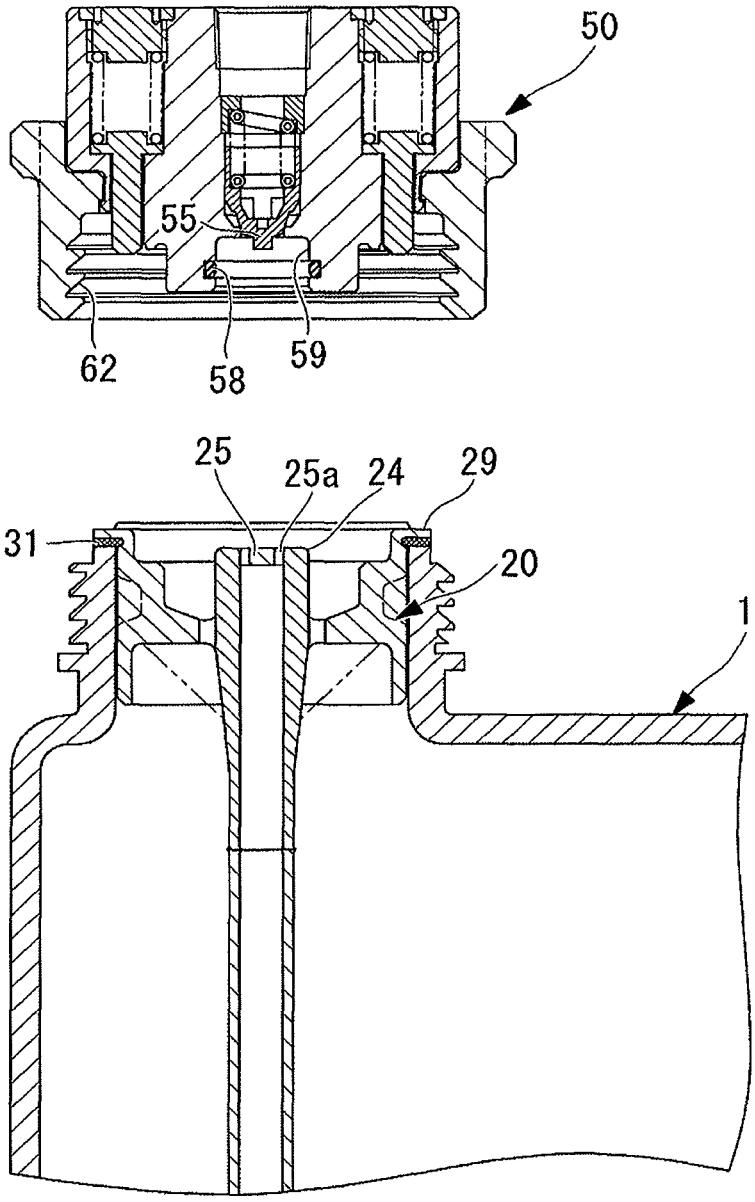
FIG. 5 is a cross-sectional view showing the state in which the socket has been separated from the plug.

In addition, the illustrated socket 50 is of a type in which a valve 55 is provided in the fluid removal path 52. Because the valve body 54a (refer to FIG. 3) is normally urged downward by the spring 54*b* (refer to FIG. 3), as shown in FIG. 5, when the plug 20 is not coupled, this valve 55 closes the fluid removal path 52 due to the valve body 54*a* being brought into close contact with the valve seat.

In contrast, as shown in FIG. 1, when the socket 50 described above is installed at a predetermined position in the plug 20, the valve actuating portion 25 that is provided on the plug 20 side presses the valve body 54*a* upward by opposing the urging force of the spring 54*b*, and thus the close contact between the valve body 54*a* and the valve seat is released. Due to the valve 55 being opened in this manner, a fluid path is formed that discharges fluid to the outside of the fluid tank 1 by the fluid passing through the siphon hose 23 and the fluid discharge path 52.

In the state that is shown in FIG. 1, in which the socket 50 is installed and fastened in the plug 20, the fluid path that communicates the space between the siphon hose 23 and the fluid removal path 52 is sealed by the O-ring 58 (the fluid sealing portion). The O-ring 58 is arranged on the inner periphery of a center hole portion 59 (refer to FIG. 5) of the socket 50, and a center tube portion 24 (refer to FIG. 5) of the plug 20 is inserted into this center hole portion 59. The coupling force between the socket 50 and the center tube portion 24 of the plug 20 is ensured by the elastic force of this O-ring 58.

Figure 7A:
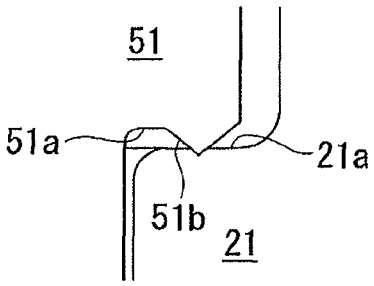
FIG. 7A is an enlarged cross-sectional view that shows the gas sealing portion and the edge seal.

In addition, a gas path communicates from the gas path 53 to the gas supply duct 22. The gas path is sealed off from the fluid path side by the O-ring 58 described above at the inner periphery of this gas path, and at the outer periphery of the gas path, a seal is formed due to the gas sealing portion 30 (refer to FIG. 1) that is formed by the step portion of the socket body 51 abutting the step portion of the plug body 21. Specifically, as shown in FIG. 7A, a convex portion (edge) 51*b*, which projects toward the plug body 21 side and has a corner portion on the distal end thereof, is formed on the step portion 51*a* of the socket body 51 over the entire periphery thereof. The gas seal is ensured by the distal end of this convex portion 51*b* being press fit against the step portion 21*a* of the plug body 21.

Figure 6:
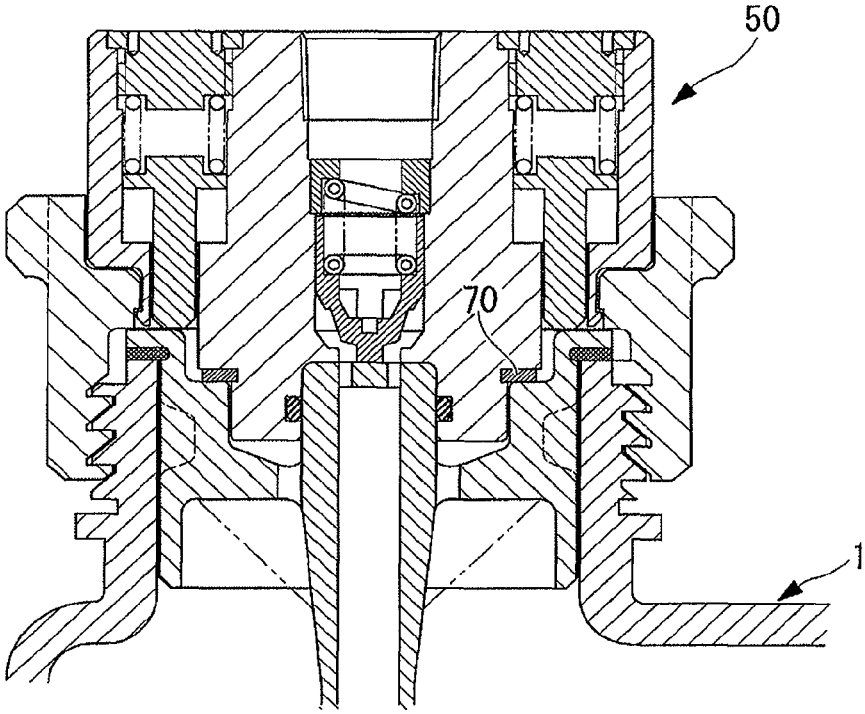
FIG. 6 is an enlarged cross-sectional view of the fluid tank connector that shows a modified example that uses packing as the gas sealing portion.
Figure 7B:
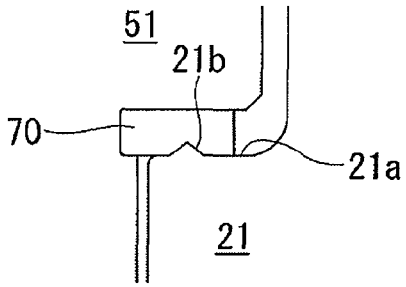
FIG. 7B is an enlarged cross-sectional view that shows the gas sealing portion and shows the packing seal.

Note that, as shown in FIG. 7B, a gas sealing portion may be provided by arranging a removable packing (sealing member) 70 on the socket body 51 side, and providing a convex portion 21*b* that is press fit against this packing 70 on the step portion 21 a of the plug body 21. The structure of the socket 50 that is provided with such as packing 70 is shown in FIG. 6. Examples of the packing 70 that can be advantageously used include polyethylene, PTFE, referred to as Teflon™, fluorocarbon rubber, and silicone rubber and the like. Because it is often the case that the socket 50 is connected and attached to a facility side that supplies the fluid and frequent replacement cannot be carried out, it is possible to improve the serviceability by providing in advance such replaceable packing 70 on the socket 50 side.

The sealed state described above is reliably maintained by the sleeve 60 of the socket 50 being threaded onto and attached to the fluid port 2 of the fluid tank 1.

As shown in FIG. 1, pressing means 80 for separating the socket 50 from the plug 20 are provided in the socket body 51. As shown in the enlarged view in FIG. 3, each pressing means 80 is provided with a pressing rod 82 that can reciprocally approach and retract from the plug 20, and a compression spring 83 that urges the pressing rod 82 downward (i.e., toward the plug 20 side). The upper end of each compression spring 83 is fastened by a stopper 84 that is fastened to the upper end of the socket body 51.

Figure 2:
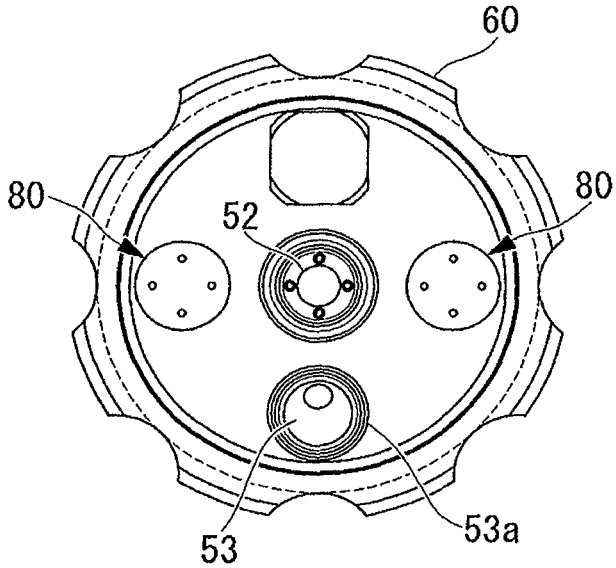
FIG. 2 is a plan view of the fluid tank connector in FIG. 1.

As shown in FIG. 2, the two pressing means 80 are symmetrically provided such that the fluid removal path 52, which is provided at the center, is interposed therebetween. In the connected state that is shown in FIG. 1, the distal end (in the figure, the lower end) of each pressing rod 82 presses the plug 20 downward due to the action of the compression spring 83 while abutting the upper end surface of the plug 20. The pressing force due to these pressing rods 82 is larger than the coupling force (i.e., the frictional force) between the plug 20 and the socket 50 that is caused by the O-ring 58 described above. Specifically, by opposing (overcoming) the coupling force caused by the O-ring 58 that forms the fluid sealing portion, a pressing force sufficient to separate the plug 20 and the socket 50 is applied by the pressing rods 82. Thereby, when the socket 50 is removed from the plug 20, it is possible to remove the socket 50 while the plug 20 continues to remain inside the fluid port 2.

Next, the operation of the fluid tank connector 10 having the structure described above during connection and release will be explained.

Figure 4:
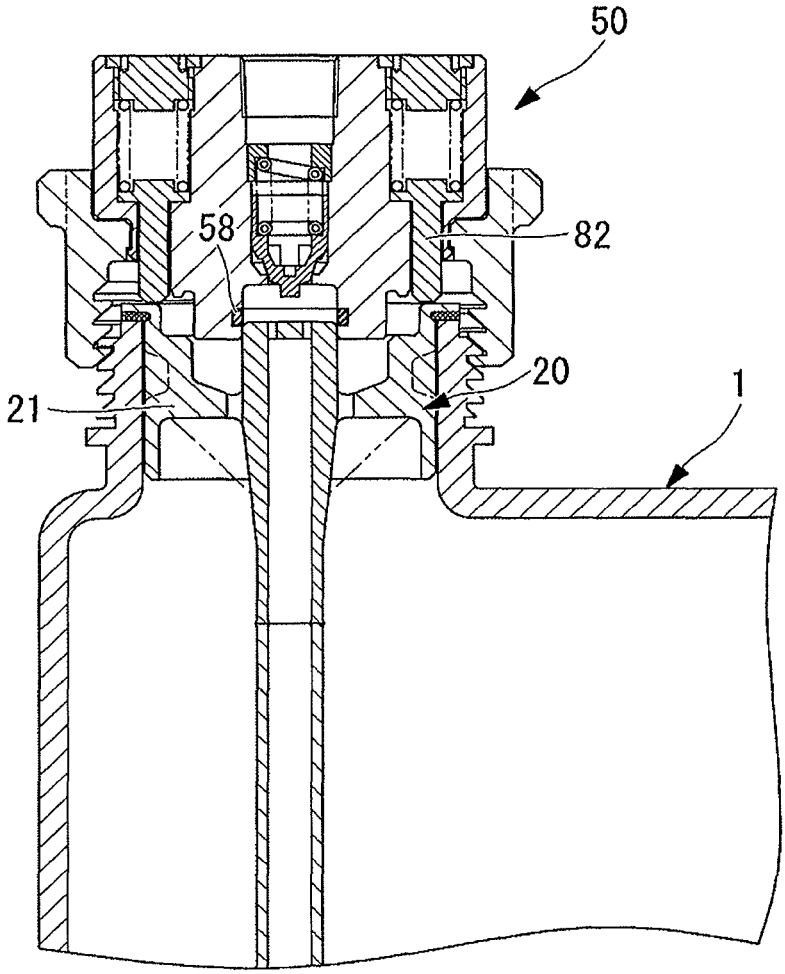
FIG. 4 is a cross-sectional view that shows the state in which the socket is partially separated from the plug.

As shown in FIG. 1, the chemical fluid inside the fluid tank 1 is removed (fluid delivery state) while the plug 20 and the socket 50 are connected. When the removal of the fluid has terminated, the sleeve 60 of the socket 50 is rotated, and the threaded state between the fluid port 2 and the sleeve 60 is loosened. The socket body 51 is thereby separated from the plug 20 to exhibit the state that is shown in FIG. 4. As shown in FIG. 4, when the socket body 51 is separated from the plug 20, the pressing rods 82 of the pressing means 80 press the plug body 21 downward, and thus, the coupling force between the plug body 21 and the socket body 51 caused by the O-ring 58 that forms the fluid sealing portion is opposed (overcome), and only the socket body 51 moves upward while the plug body 21 continues to remain inside the fluid port 2.

Furthermore, when the sleeve 60 is rotated to release the threading with the fluid port 2, as shown in FIG. 5, the socket 50 is completely separated from the plug 20.

Figure 8:
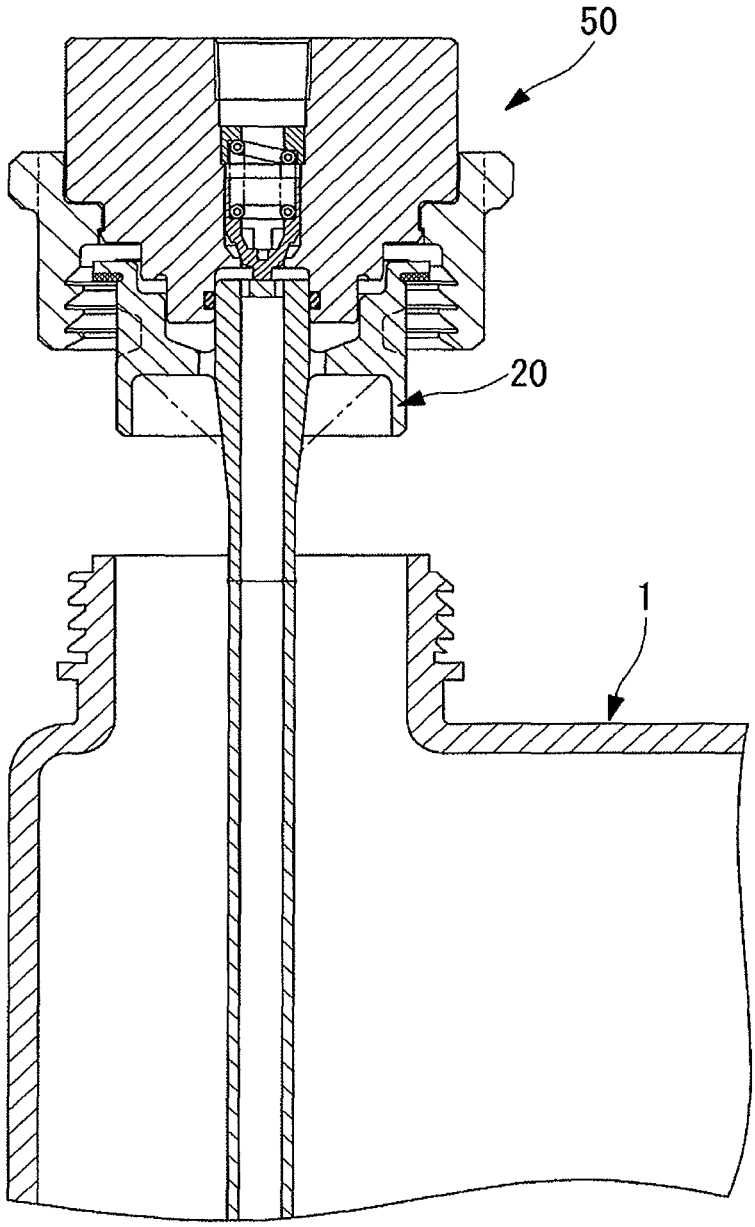
FIG. 8 is a cross-sectional view that shows a comparative example of the present invention, and shows the state in which the plug is separated along with the socket from the fluid port of the fluid tank.

As a comparative example, FIG. 8 shows a fluid tank connector that is not provided with the pressing means 80 such as the one in the present invention. When the pressing means 80 are not provided, as explained with reference to FIG. 4, it is not possible to separate the plug body 21 from the socket body 51 because the coupling force caused by the O-ring 58 cannot be overcome, and thus the plug 20 is removed from the fluid tank 1 along with the socket 50. In particular, in the present embodiment, because a structure is used in which the plug 20 is fit with play into the fluid port 2, the plug 20 is easily removed along with the socket.

In the manner described above, according to the present embodiment, because the pressing means 80 are provided in the socket 50 and separate the plug 20 from the socket 50 by opposing the coupling force caused by the O-ring 58 that forms the fluid sealing portion, when the socket 50 is separated from the plug 20, the socket 50 can be reliably separated from the plug 20 while the plug 20 continues to remain connected to the fluid tank 1 side.

Note that in the embodiment described above, when fluid is removed from the inside of the fluid tank 1, gas pressure is supplied into the fluid tank 1, the pressure acts on the fluid surface, and the fluid is pressurized and removed due to this pressure (siphon hose method). However, it is also possible to connect piping to the fluid removal path 52 of the socket 50 and discharge the fluid by using a pump. In this case, the gas path 53 serves as a path for supplying and replacing the air and the like inside the fluid tank 1 by an amount equivalent to the decrease of the fluid.

The invention claimed is:

1. A fluid tank connector comprising:

a plug that is fit with play in the inner periphery of a fluid port of a fluid tank that stores a fluid and a socket that is detachably connectable to the plug; wherein the socket includes a sleeve that is detachably connectable to the plug by being threadable into a thread groove that is formed in the outer periphery of the fluid port;

in a fluid delivery state in which the plug and the socket are connected, a fluid path that delivers fluid from the fluid tank and a gas path that supplies gas into the fluid tank are formed; and in the socket, a pressing means that is configured to press the plug with a pressing force opposing a coupling force of a fluid sealing portion that seals the fluid path between the plug and the socket is provided to enable the socket to be removed from the plug while the plug remains fit with play to the fluid port of the fluid tank.

2. The fluid tank connected according to claim 1, wherein:

a gas sealing portion that seals the gas path is provided between the plug and the socket; and the gas sealing portion is provided with a replaceable sealing member that is provided on the socket side.

* * * * *